US007766805B1

(12) United States Patent
Horne

(10) Patent No.: US 7,766,805 B1
(45) Date of Patent: Aug. 3, 2010

(54) TRICEPS EXERCISE APPARATUS

(76) Inventor: Michael E. Horne, 8113 Highway 178 South, Ninety Six, SC (US) 29666

( * ) Notice: Subject to any disclaimer, the term of this patent is extended or adjusted under 35 U.S.C. 154(b) by 0 days.

(21) Appl. No.: 12/431,654

(22) Filed: Apr. 28, 2009

(51) Int. Cl.
*A63B 21/02* (2006.01)

(52) U.S. Cl. ..... 482/124; 482/121

(58) Field of Classification Search ..... 482/44, 482/121–124, 126
See application file for complete search history.

(56) References Cited

U.S. PATENT DOCUMENTS

| | | | | | |
|---|---|---|---|---|---|
| 1,669,499 | A | * | 5/1928 | Titus | 482/122 |
| 1,734,238 | A | * | 11/1929 | Sweeney | 482/123 |
| 1,952,750 | A | * | 3/1934 | Gailey | 482/125 |
| 3,118,441 | A | * | 1/1964 | Prosser | 601/23 |
| 3,451,675 | A | | 6/1969 | Burzenski | |
| 4,856,776 | A | | 8/1989 | Ching-Liang | |
| 4,993,705 | A | | 2/1991 | Tolle | |
| 5,197,934 | A | * | 3/1993 | Wirtz | 482/123 |
| 5,518,481 | A | | 5/1996 | Darkwah | |
| 5,857,948 | A | * | 1/1999 | Barnett | 482/140 |
| 6,007,463 | A | * | 12/1999 | Wells et al. | 482/126 |
| 6,244,994 | B1 | | 6/2001 | Tilberis | |
| 6,244,998 | B1 | * | 6/2001 | Hinds | 482/126 |
| 6,390,959 | B1 | | 5/2002 | Tornabene et al. | |
| D508,097 | S | | 8/2005 | Perez | |
| 7,044,894 | B1 | | 5/2006 | Smith | |
| 2007/0287616 | A1 | | 12/2007 | Weaver | |

* cited by examiner

*Primary Examiner*—Fenn C Mathew
*Assistant Examiner*—Andrew M Tecco
(74) *Attorney, Agent, or Firm*—Crossley Patent Law; Mark A. Crossley

(57) ABSTRACT

The triceps exercise apparatus is self-contained and needs no anchor or attachment, whether to a user or to an external object. The pouch of the apparatus is pliable and filled with a conforming, pliable weight mass that allows the pouch to rest comfortably over a user's shoulder. The apparatus requires only one hand for use. There is no requirement for grasping with a second hand or anchoring via any other body part. The advantages afforded by this feature are important. For example, an amputee having only one hand or arm can still use the apparatus as effectively as another. A person who cannot, for whatever reason, use a second hand or arm can also use the apparatus. A person undergoing rehabilitation with a focus on only one arm can effectively use the apparatus. Full triceps concentric and eccentric contraction is provided.

2 Claims, 3 Drawing Sheets

TRICEPS EXERCISE APPARATUS

BACKGROUND OF THE INVENTION

There remains room for improvement and variation among exercise devices, and particularly triceps exercise devices. Certainly improvements can be made by developing devices that do not require equipment to be rested or anchored to a user's body or an external object. And, the more basic a device can be made while retaining functionality certainly has an attraction and usefulness to users. The present apparatus provides a self-contained triceps exercise apparatus that a user keeps to himself/herself, without need of any non-personal or personal anchor or attachment or weights. Further, the device can be used with only one hand.

FIELD OF THE INVENTION

The triceps exercise apparatus relates to exercise equipment and more especially to a personal triceps exercise apparatus that requires no non-personal or personal anchor, attachment, or weights.

SUMMARY OF THE INVENTION

The general purpose of the triceps exercise apparatus, described subsequently in greater detail, is to provide a triceps exercise apparatus which has many novel features that result in an improved triceps exercise apparatus which is not anticipated, rendered obvious, suggested, or even implied by prior art, either alone or in combination thereof.

To attain this, the triceps exercise apparatus is self-contained and needs no anchor or attachment, whether to a user or an external object. The pouch of the apparatus is pliable and filled with a conforming, pliable weight mass that allows the pouch to rest comfortably over a user's shoulder. Also important, the apparatus requires only one hand for use. There is no requirement for grasping with a second hand or anchoring via any other body part. The advantages afforded by this feature are important. For example, an amputee having only one hand or arm can still use the apparatus as effectively as another. A person who cannot, for whatever reason, use a second hand or arm can also use the apparatus. A person undergoing rehabilitation with a focus on only one arm can effectively use the apparatus. Further, one hand and arm can effectively use the apparatus while the second hand and arm are involved in another activity. Additionally, the apparatus provides full concentric and eccentric contraction and range of motion for the triceps muscle group. Full range contractile ability is important in involving all muscle fibers of a muscle group in an activity. The three muscles of the triceps group are therefore effectively exercised.

Other advantages offered by the apparatus include the ability to change resistance. Various forms of resistance members can be interchanged, and the various resistance members provide varied resistance forces. Additionally, further variation in resistance is provided by the fact that a user can choose either one or two resistance members. Also, a user can turn their involved hand at various angles to further address the three triceps muscles in slightly different involvement in the exercise. Pouch sizes and weights are not limited and range from relatively light to relatively heavy. A pouch can be positioned as chosen over a user's shoulder to further counteract resistance and activity. The cushion extended forwardly from the pouch ensures that no irritation of a user's torso is encountered from the attachments and resistance members.

Having the tang with eyelets elevated above the cushion further insures against user aggravation.

Thus has been broadly outlined the more important features of the improved triceps exercise apparatus so that the detailed description thereof that follows may be better understood and in order that the present contribution to the art may be better appreciated.

An object of the triceps exercise apparatus is to require no attachment to a user.

Another object of the triceps exercise apparatus is to require no attachment to an object external to the user.

A further object of the triceps exercise apparatus is to be effective with the use of only one arm.

An added object of the triceps exercise apparatus is to provide for full concentric and eccentric contraction of the triceps muscle group.

And, an object of the triceps exercise apparatus is to be especially useful for rehabilitation.

Yet another object of the triceps exercise apparatus is to provide resistance variation.

A further object of the triceps exercise apparatus is to provide cushioned contact with a user.

These together with additional objects, features and advantages of the improved triceps exercise apparatus will be readily apparent to those of ordinary skill in the art upon reading the following detailed description of presently preferred, but nonetheless illustrative, embodiments of the improved triceps exercise apparatus when taken in conjunction with the accompanying drawings.

In this respect, before explaining the current embodiments of the improved triceps exercise apparatus in detail, it is to be understood that the triceps exercise apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved triceps exercise apparatus. It is therefore important that the claims be regarded as including such equivalent constructions insofar as they do not depart from the spirit and scope of the triceps exercise apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the triceps exercise apparatus generally designated by the reference number 10 will be described.

Figure 1:
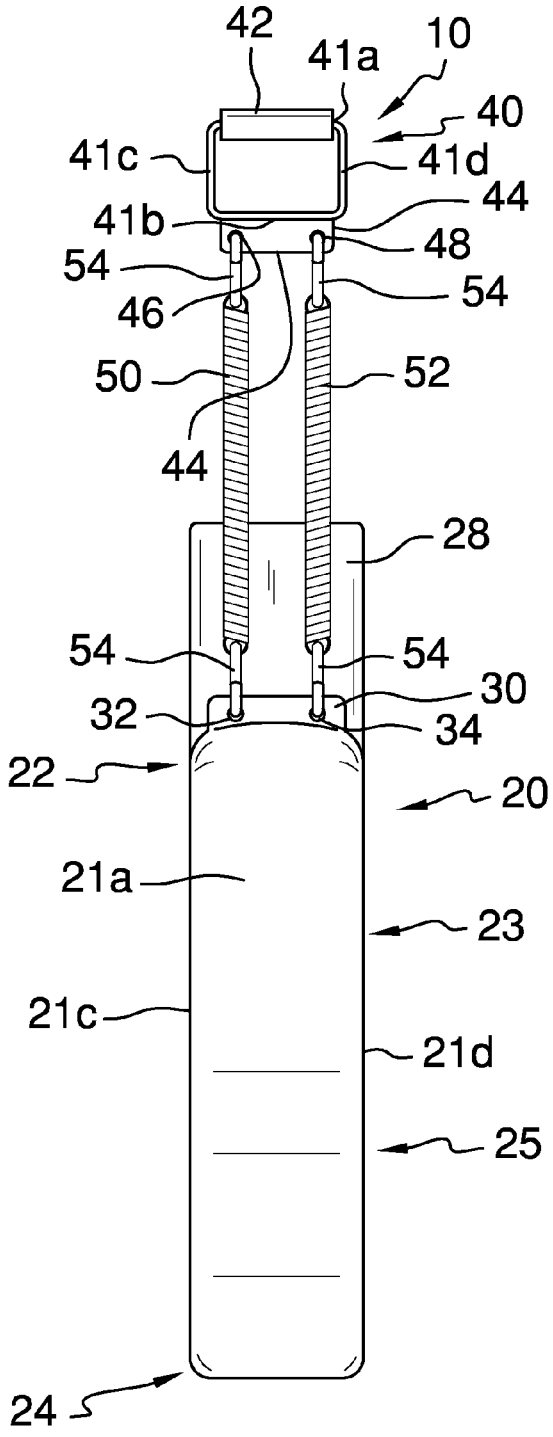
FIG. 1 is a top plan view.
Figure 2:
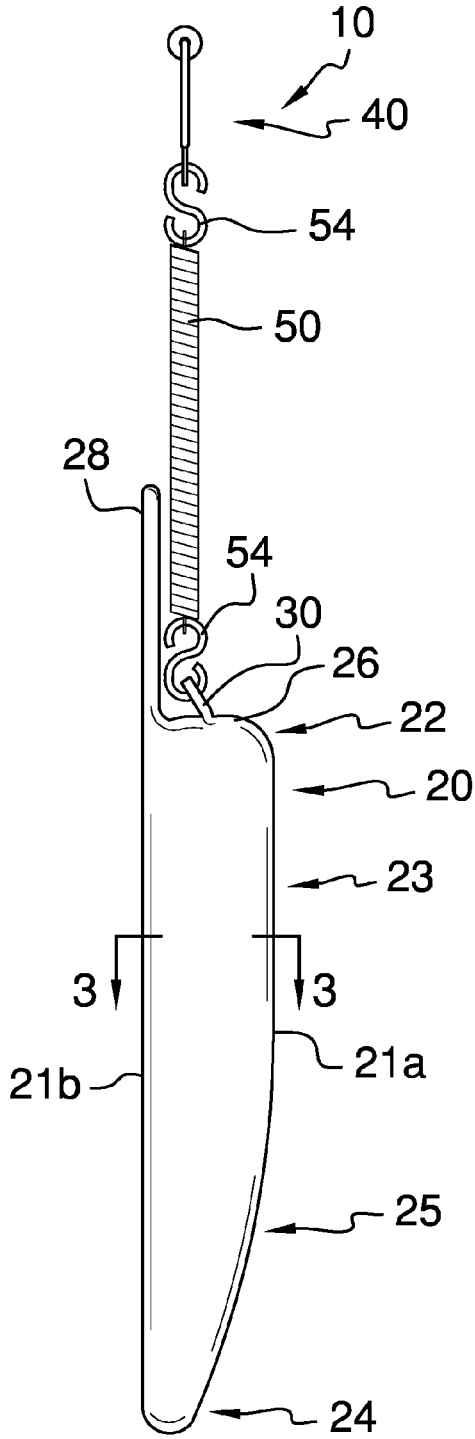
FIG. 2 is a lateral elevation view.

Referring to FIGS. 1 and 2, the apparatus 10 partially comprises the pliable pouch 20 having a top 21*a* spaced apart from a flat bottom 21*b*, a first side 21*c* spaced apart from a second side 21*d*, and a front 22 spaced apart from a rear 24. The pouch further comprises an upper body 23 having a taper 25 from the upper body 23 to the rear 24 and a front wall 26 perpendicularly extended from the pouch 20 front 22 upper body 23.

Figure 3:
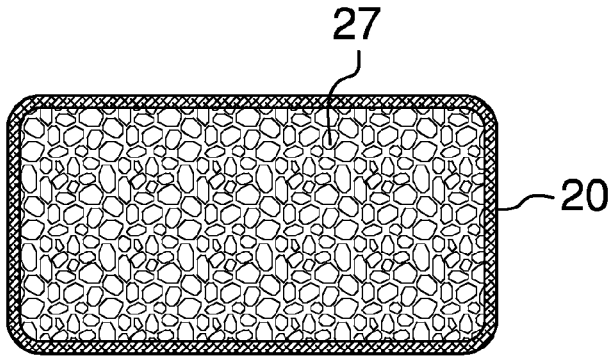
FIG. 3 is a cross sectional view of FIG. 2, taken along the line 3-3.

Continuing to refer to FIGS. 1 and 2 and referring also to FIG. 3, the apparatus further comprises a conforming weight 27 disposed within the pouch 20. Various materials optionally make up the conforming weight 27 and include but are not limited to sand as well as shot formed from various metals. Further, various masses of weight 27 are available in various sized pouches 20.

Referring again to FIGS. 1 and 2, the pouch 20 further comprises a flat cushion 28 extended forwardly from the flat bottom 21*b* and front wall 26. The pair of identical spaced apart eyelets is disposed in the tang 30 extended from the front wall 26. The eyelets comprise the first eyelet 32 and the second eyelet 34. The quartet of identical removable attachments 54 is provided. Attachments 54 are optionally S-hooks, carabiners, and other such appropriate detachable attachments 54 known in the arts. One of the attachments 54 is disposed in each eyelet. The pair of elastic resistance members comprises the first elastic resistance member 50 removably attached to the attachment 54 of the first eyelet 32. The second elastic resistance member 52 is removably attached to the second eyelet 34 attachment 54. The hollow rectangular handle 40 comprises the front bar 41*a* spaced apart from the rear bar 41*b* and the first side bar 41*c* spaced apart from the second side bar 41*d*. The roller grip 42 is rotatably disposed on the front bar 41*a*. The flat extension 44 is attached to the rear bar 41*b*. A pair of spaced apart extension eyelets is disposed in the flat extension 44. The extension eyelets comprise the first extension eyelet 46 and the second extension eyelet 48. The first extension eyelet 46 is removably affixed to the first elastic resistance member 50 via one of the attachments 54. The second extension eyelet 48 is removably affixed to the second elastic resistance member 52 via one of the attachments 54. Elastic resistance members can be comprised of springs or rubberized bands, or other appropriate stretchable materials with memory. Either one or two elastic members can be selectively attached.

Figure 4:
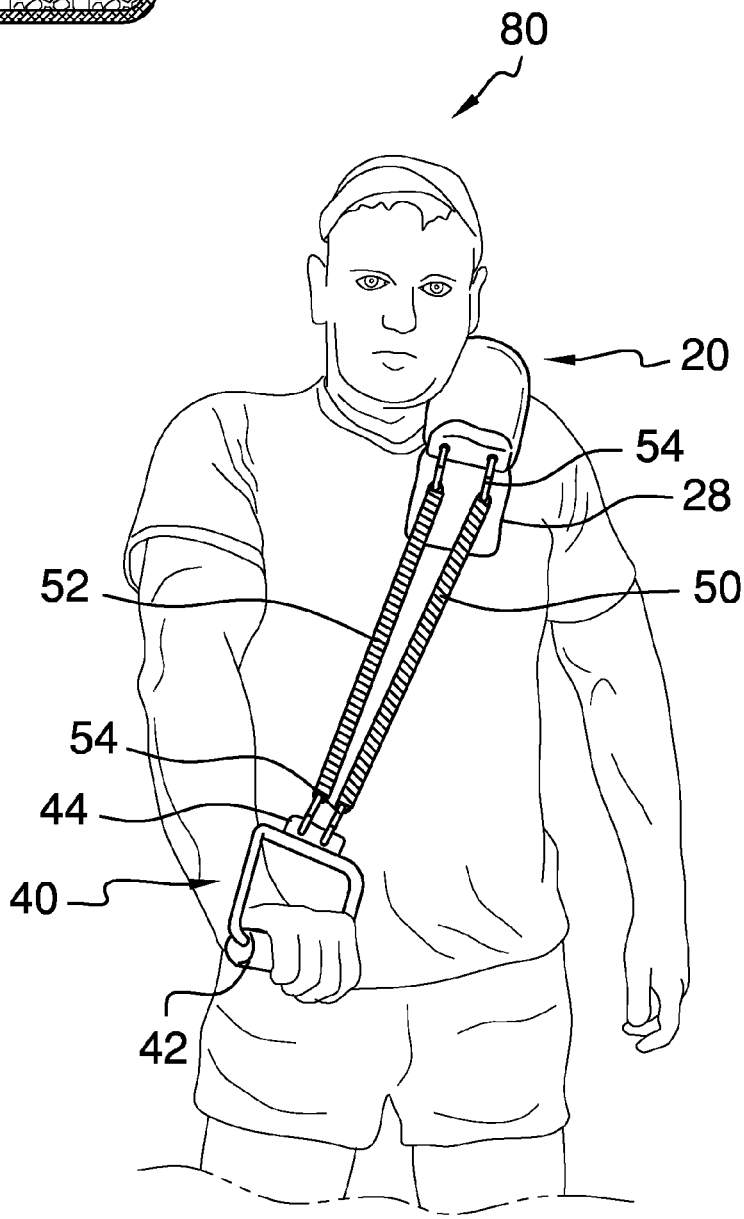
FIG. 4 is a front perspective view of the apparatus in use.
Figure 5:
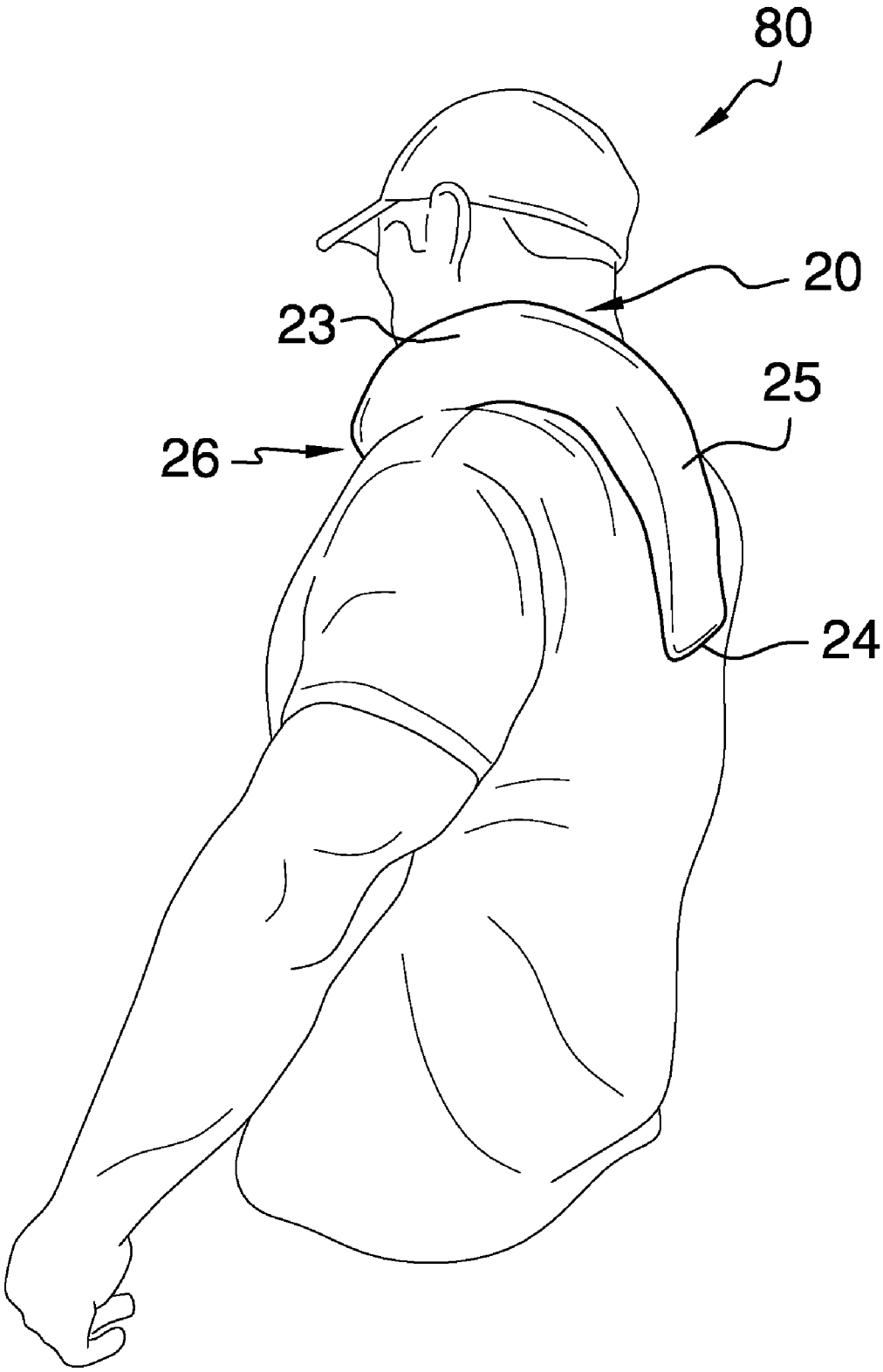
FIG. 5 is a lateral perspective view of the apparatus in use.

Referring to FIGS. 4 and 5, the pouch 20 is placed over the shoulder of a user 80. The pliable pouch 20 and conforming weight 27 within allow the pouch to fall comfortably over the shoulder and conform to the user's 80 body. The handle 40 is grasped by one hand of the user 80. A user 80 can use the hand opposite the shoulder upon which the pouch rests, or even the hand connected to the same shoulder. If comparatively greater resistance is chosen by the user 80, whether through the use of two resistance members or resistance members that provide greater unit resistance per member, the pouch 20 can be placed farther over the shoulder in compensation. The user 80 then extends the handle 40 grasping hand downwardly or forwardly or both, depending upon the angle of exercise desired. If full contraction is desired, the user 80 extends the hand until the arm is fully straight in order for the triceps to experience full concentric contraction. The user 80 then resists the return of the arm to a bent position in exercising the triceps muscle in eccentric contraction.

With respect to the above description then, it is to be realized that the optimum dimensional relationships for the parts of the triceps exercise apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the triceps exercise apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the triceps exercise apparatus may be used.

Therefore, the foregoing is considered as illustrative only of the principles of the triceps exercise apparatus. Further, since numerous modifications and changes will readily occur to those skilled in the art, it is not desired to limit the triceps exercise apparatus to the exact construction and operation shown and described, and accordingly, all suitable modifications and equivalents may be resorted to, falling within the scope of the triceps exercise apparatus.

What is claimed is:

1. A triceps exercise apparatus, comprising, in combination:

a pliable pouch having a top spaced apart from a flat bottom, a first side spaced apart from a second side, a front spaced apart from a rear, an upper body having a taper from the upper body to the rear, a front wall perpendicularly extended from the pouch front upper body, the pouch adapted to be removably positioned over a user's shoulder;

a conforming weight disposed within the pouch;

a flat cushion extended forwardly from the flat bottom and front wall;

a tang extended from the front wall;

a pair of identical spaced apart eyelets disposed in the tang, the eyelets comprising a first eyelet and a second eyelet;

a pair of elastic resistance members comprising a first elastic resistance member attached to the first eyelet, a second elastic resistance member attached to the second eyelet;

a hollow rectangular handle comprising a front bar spaced apart from a rear bar, a first side bar spaced apart from a second side bar, a roller grip rotatably disposed on the front bar, a flat extension attached to the rear bar, a pair of spaced apart extension eyelets disposed in the flat extension, the extension eyelets comprising a first extension eyelet and a second extension eyelet, the first extension eyelet affixed to the first resistance member, the second extension eyelet affixed to the second resistance member, the handle adapted to be grasped by one hand of the user.

2. A triceps exercise apparatus, comprising, in combination:

a pliable pouch having a top spaced apart from a flat bottom, a first side spaced apart from a second side, a front spaced apart from a rear, an upper body having a taper from the upper body to the rear, a front wall perpendicularly extended from the front pouch upper body, the pouch adapted to be removably positioned over a user's shoulder;

a mass of conforming weight disposed within the pouch;

a flat cushion extended forwardly from the flat bottom and front wall;

a tang extended from the front wall;

a pair of identical spaced apart eyelets disposed in the tang, the eyelets comprising a first eyelet and a second eyelet;

a quartet of identical removable attachments, one of the attachments disposed in each eyelet;

a pair of elastic resistance members comprising a first elastic resistance member removably attached to the attachment of the first eyelet, a second elastic resistance member removably attached to the second eyelet attachment;

a hollow rectangular handle comprising a front bar spaced apart from a rear bar, a first side bar spaced apart from a second side bar, a roller grip rotatably disposed on the front bar, a flat extension attached to the rear bar, a pair of spaced apart extension eyelets disposed in the flat extension, the extension eyelets comprising a first extension eyelet and a second extension eyelet, the first extension eyelet removably affixed to the first resistance member via one of the attachments, the second extension eyelet removably affixed to the second resistance member via one of the attachments, the handle adapted to be grasped by one hand of the user.

* * * * *